US006678979B2

(12) United States Patent
Lim et al.

(10) Patent No.: US 6,678,979 B2
(45) Date of Patent: Jan. 20, 2004

(54) WIND INDICATOR

(75) Inventors: Albert Lim, Arlington, VA (US); Valentine B. Deale, Kensington, MD (US)

(73) Assignee: Premier Kites, Hyattsville, MD (US)

( * ) Notice: Subject to any disclaimer, the term of this patent is extended or adjusted under 35 U.S.C. 154(b) by 115 days.

(21) Appl. No.: 10/117,176

(22) Filed: Apr. 8, 2002

(65) Prior Publication Data

US 2003/0126774 A1 Jul. 10, 2003

Related U.S. Application Data

(60) Provisional application No. 60/345,655, filed on Jan. 8, 2002.

(51) Int. Cl.[7] ..... A63H 33/40

(52) U.S. Cl. ..... 40/412; 40/440; 446/217; 446/218; 446/236

(58) Field of Search ..... 40/412, 440; 446/201, 446/217, 218, 236

(56) References Cited

U.S. PATENT DOCUMENTS

| | | | |
|---|---|---|---|
| 571,449 | A | 11/1896 | Laube |
| 1,337,483 | A | 4/1920 | Romaniello |
| 1,421,161 | A | 6/1922 | Browne |
| 1,464,993 | A | 8/1923 | Leszczynski |
| 1,467,336 | A | 9/1923 | Rumfelt |
| 1,583,881 | A | 5/1926 | Heberling |
| 1,681,415 | A | 8/1928 | Lee |
| 1,994,842 | A | 3/1935 | Turner |
| 2,170,771 | A | 8/1939 | Benjamin |
| 2,313,357 | A | 3/1943 | Pajeau |
| 2,510,336 | A | 6/1950 | Donahue |
| 2,533,110 | A | 12/1950 | Harbert |
| 2,545,801 | A | 3/1951 | Wrazen |
| 2,638,705 | A | 5/1953 | Petrasy |
| 3,220,253 | A | 11/1965 | Parker |
| 3,221,440 | A | 12/1965 | Gutierrez |
| 3,252,241 | A | 5/1966 | Gould |
| 3,732,730 | A | 5/1973 | Kwolek |

(List continued on next page.)

FOREIGN PATENT DOCUMENTS

| | | |
|---|---|---|
| DE | 296 13 696 U1 | 12/1996 |
| DE | 297 10 575 U1 | 10/1997 |
| EP | 0 199 839 | 11/1986 |

OTHER PUBLICATIONS

"Wizards of Oztrailia", American, Winter/Spring 1999, Front and Back Cover (2 pp.).

"Sport Kiting", 1996, vol. 4 No. 2, Front Cover and p. 15 (2pp.).

"Drachen Magazin", Juli/Aug., Jahrgang IX—Heft 5/97 (2 pp.).

"WindGrden" by Premier Designs Catalog (32 pp.) (Sep. 2001).

"go fly a kite", 2000 Catalog (86 pp.).

*Primary Examiner*—Cassandra H. Davis
(74) *Attorney, Agent, or Firm*—Pillsbury Winthrop LLP

(57) ABSTRACT

A wind indicator is described that includes a body with a frame including a spindle axis and a web. A pivot is connected to the frame to permit the body to rotate about a pivot axis. A spindle is disposed on the spindle axis and is rotatable about the spindle axis. The spindle includes first and second hubs, each of which include a central body portion and at least one vane support receiving element. The wind indicator also has at least one element connecting the first hub to the second hub to maintain the first and second hubs in positional relation with respect to one another. The connecting element is offset from the spindle axis by a predetermined distance. At least one vane extends between the vane support receiving elements on the two hubs. The vane captures air movement and translates it into rotational movement of the spindle.

20 Claims, 12 Drawing Sheets

U.S. PATENT DOCUMENTS

| | | | | |
|---|---|---|---|---|
| 3,747,263 | A | | 7/1973 | Grossberg |
| 3,786,583 | A | | 1/1974 | Revor |
| 3,941,504 | A | | 3/1976 | Snarbach |
| 3,974,369 | A | | 8/1976 | Chmela et al. |
| 4,120,561 | A | | 10/1978 | Burkholder |
| 4,207,026 | A | | 6/1980 | Kushto |
| 4,227,406 | A | | 10/1980 | Coffey |
| 4,548,073 | A | | 10/1985 | Ludden |
| 4,582,497 | A | | 4/1986 | Lyons |
| 4,620,385 | A | | 11/1986 | Carranza et al. |
| 4,778,132 | A | | 10/1988 | Stoecklin et al. |
| 4,897,068 | A | | 1/1990 | Jackson |
| 4,908,000 | A | | 3/1990 | Counts |
| 5,085,075 | A | | 2/1992 | Baker |
| 5,127,358 | A | | 7/1992 | Galloway et al. |
| 5,241,771 | A | | 9/1993 | Caustic |
| 5,241,777 | A | | 9/1993 | Looker et al. |
| 5,332,364 | A | | 7/1994 | Rodarmer |
| 5,368,515 | A | | 11/1994 | Mast |
| 5,659,988 | A | | 8/1997 | Kim et al. |
| 5,727,980 | A | | 3/1998 | Stipa |
| 5,811,673 | A | | 9/1998 | Kwok et al. |
| 5,928,051 | A | | 7/1999 | Krog |
| 5,971,828 | A | | 10/1999 | Lin |
| 6,074,267 | A | | 6/2000 | Plow |
| 6,206,747 | B1 | | 3/2001 | Skwarek |
| 6,398,615 | B1 | * | 6/2002 | Wu et al. ..... 446/217 |
| 6,475,056 | B1 | * | 11/2002 | Christianson ..... 446/201 |
| 6,592,424 | B1 | * | 7/2003 | Christianson ..... 446/201 |

* cited by examiner

WIND INDICATOR

The present application relies for priority on U.S. Provisional Patent Application Serial No. 60/345,655, entitled "WIND INDICATOR," which was filed on Jan. 8, 2002, the entirety of which is incorporated herein by reference.

BACKGROUND OF THE INVENTION

1. Field of the Invention

The present invention relates to a novelty generically known as a "wind indicator," a device that is more commonly referred to as "garden spinner."

2. Brief Description of Selected Examples from the Prior Art

The prior art is replete with various examples of wind indicators. Some are entirely utilitarian and lack substantially any ornamental features. Others are designed to include one or more distinguishing ornamental features.

As for wind indicators that lack substantially any ornamental features, the common windsock that is found at most (if not all) airports to indicate the direction in which the wind is blowing is one example. While windsocks provide an excellent indication of wind direction, they offer nothing from an ornamental standpoint.

Other wind indicators, while also functional, are designed with a more decorative platform in mind. Examples of wind indicators of this type include weather vanes, such as the type commonly disposed on barns and farm structures.

A recent trend suggests that decorative wind indicators are becoming increasingly popular as lawn or garden ornaments. In response to this demand, several manufacturers are now designing and producing a variety of wind indicators for public consumption.

One example is described in U.S. Pat. No. 6,206,747 ("the '747 patent"). In this example, the wind indicator includes a pivot doll 9 that permits the device to rotate about a ground stake 2. The device also includes a rigid piece 22 over which a hollow rod 70 is positioned. The hollow rod 70, which slides over the rigid piece 22, has disk type structures 24, 25 attached at either end. The disks support wind catching tails 23, which rotate about the rigid piece 22.

The wind indicator described and illustrated in this patent suffers from several disadvantages, most of which are the direct result of utilizing a hollow rod 70 and disk shaped structures 24, 25 to carry the wind catching tails 23. Some of the disadvantages are listed below.

One disadvantage is that the hollow rod 70 provides a significantly long interior surface in contact with the rigid piece 22. As a result, there is a significant amount of friction between the two elements. Therefore, a respectable wind is needed to overcome the frictional forces between the two structures before the wind catching tails 23 begin to spin about the rigid piece 22.

In addition, the hollow tube 70 may become fouled with pollen, dirt, and other materials when the wind indicator is left outside for extended periods of time. If materials build up between the hollow tube 70 and the rigid piece 22, these materials further inhibit rotational movement of the wind catching tails 23.

Another disadvantage with the wind indicator described in the '747 patent concerns the pivot doll 9. In the embodiment illustrated in FIGS. 4 and 5, the ground stake 2 inserts directly into the pivot doll 9. Therefore, the wind indicator may be easily separated from the ground stake 2 under moderately windy conditions.

In addition, the hollow rod 70 and disks 24, 25 are retained on the rigid piece 22 by a cap 71, which is fitted onto the end of the rigid piece. The end cap 71, however, may be easily dislodged in a stiff wind, which could result in disassembly of the wind indicator.

Each of these disadvantages, among others, are not addressed by the prior art and cry out for a solution.

SUMMARY OF THE INVENTION

Therefore, it is one aspect of the present invention to provide a wind indicator that is improved over wind indicators found in the prior art.

Another aspect of the present invention is to provide a spindle that has minimal contact with the spindle axis to facilitate rotation of the spindle thereon. The spindle design also minimizes fouling at the contact points with the supporting spindle axis.

One further aspect of the present invention is to provide a spindle having two hubs, the hubs being connected to one another by one or more connector elements. The connector elements are disposed a predetermined distance from the spindle axis.

Still another aspect of the present invention lies in the provision of an acorn hub with gripping elements to securely, yet removably, retain the spindle on the spindle axis.

One additional aspect of the present invention is the provision of a pivot that includes a retaining collar. In operation, together with a retaining collar disposed on the ground stake, the two collars interfere with one another to securely hold the body of the wind indicator to the ground stake.

Another aspect of the present invention is the provision of one or more sound-generating devices on the rotating spindle to scare away small animals, such as rodents, from the area in which the wind indicator has been placed.

In furtherance of these aspects, the present invention provides for a wind indicator that includes a body with a frame having a spindle axis. A web is disposed on at least a portion of the frame. A pivot is connected to the frame. The pivot permits the body to rotate about a pivot axis. A spindle is disposed on the spindle axis and is rotatable about the spindle axis. The spindle includes a first hub with a first hub central body portion and at least one first vane support receiving element extending outwardly therefrom. The spindle also includes a second hub with a second hub central body portion and at least one second vane support receiving element extending outwardly therefrom. At least one element connects the first hub to the second hub to maintain the first and second hubs in positional relation with respect to one another. The at least one element is offset from the spindle axis by a predetermined distance. At least one vane extends between the first and second vane support receiving elements. The vane is capable of capturing air movement and translating it into rotational movement of the spindle.

Other aspect of the present invention will become apparent from the description that follows and the drawings associated therewith.

BRIEF DESCRIPTION OF THE FIGURES

The figures of the present invention appended hereto are not intended to limit the scope of the invention in any way. To the contrary, the figures are intended to illustrate one or more possible embodiments of the present invention, in which.

DESCRIPTION OF EMBODIMENTS OF THE INVENTION

Figure 1:
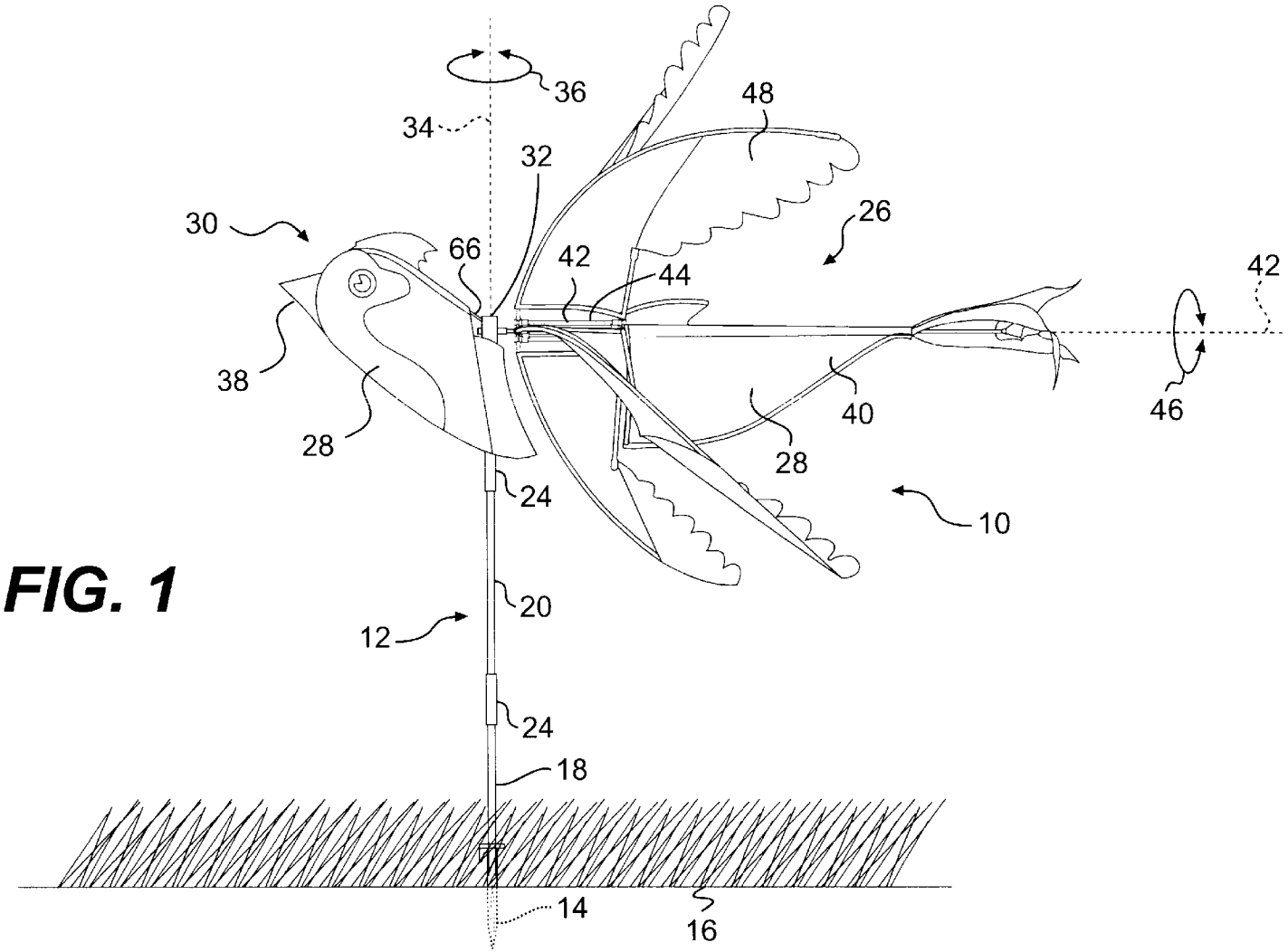
FIG. 1 is a side view of one embodiment of the present invention, where the wind indicator is in the shape of a bird.

FIG. 1 illustrates a first embodiment of the wind indicator 10 of the present invention. The wind indicator 10 shown is in the design of a bird. As would be appreciated by those of ordinary skill in the art (and as provided by the example shown in FIG. 2), the wind indicator 10 may take any suitable shape (any type of animal or other suitable decorative design) and still remain within the intended scope of the present invention. In other words, the overall shape and appearance of the wind indicator 10 encompasses decorative and non-functional aspects that are not relevant to the utilitarian features of the present invention.

Figure 10:
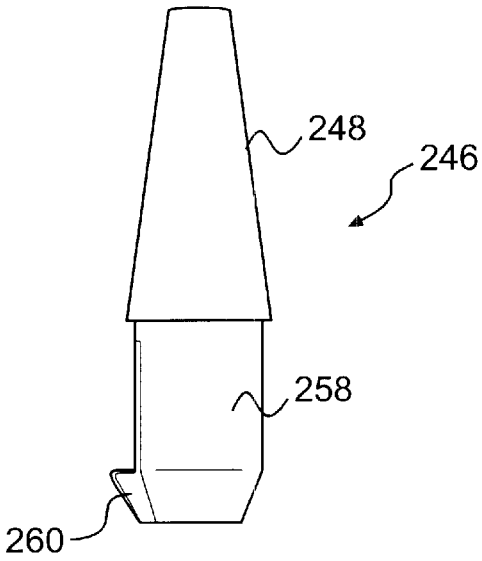
FIG. 10 is a side view of a second embodiment of the vane support that inserts into the spindle of the present invention.

The wind indicator 10 shown in FIG. 10 sits atop a ground stake 12 with a ground-penetrating tip 14. The ground-penetrating tip 14 is inserted into the ground 16 (or other suitable surface) to hold the wind indicator 10 in a generally upright position. As would be appreciated by those skilled in the art, however, the wind indicator 10 of the present invention need not be perched atop a ground stake 12 that has been inserted into a ground-penetrating tip 14. To the contrary, the wind indicator 10 may be positioned atop a stake (or other suitable supporting structure or element) that may be attachable to any suitable object, such as a railing, bird feeder, garden bench, etc. Moreover, the wind indicator 10 of the present invention also may be designed to attach to a moving object such as a car. In other words, while it is envisioned that the wind indicator 10 of the present invention will be utilized as a garden embellishment, there are innumerable uses of the present invention that are intended to be encompassed by the description that follows and the claims that are appended hereto.

Figure 2:
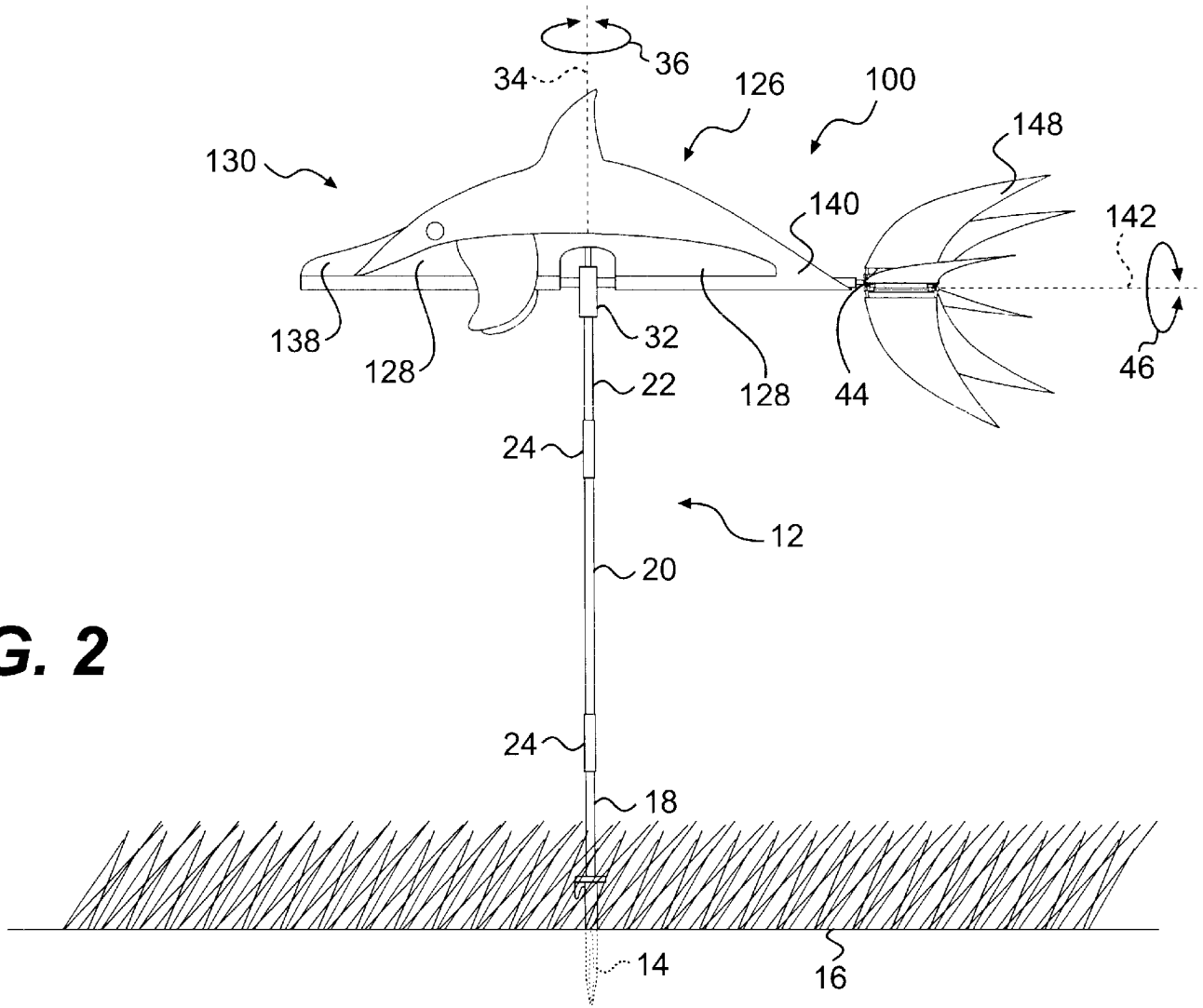
FIG. 2 is a side view of a second embodiment of the present invention, where the wind indicator is in the shape of a dolphin.

In the embodiment illustrated, the ground stake 12 has three separate sections. Of the three separate sections, only two are visible in FIG. 1. (For a view of all three sections, refer to FIG. 2.) The sections illustrated in FIGS. 1 and 2 are a lower ground stake element 18, an intermediate ground stake element 20, and an upper ground stake element 22. The ground stake elements 18, 20, 22 are coupled to one another via connectors 24. The elements 18, 20, 22 and the connectors 24 may be made of plastic or some other suitable resilient material that resists degradation when exposed, for extended periods of time, to environmental conditions.

As indicated, the ground stake 12 comprises two or more elements 18, 20, 22. This number of elements 18, 20, 22 is suggested so that the elements 18, 20, 22 may be separated from one another and packaged compactly with the remaining parts of the wind indicator 10. Of course, as would be appreciated by those skilled in the art, the ground stake 12 may be a single element without departing from the intended scope of the present invention.

In the embodiment illustrated, the lower ground stake element 18 inserts into the ground-penetrating tip 14. This arrangement permits the ground penetrating tip 14 to be inserted into the ground 16, for example by pressure from a person's foot, followed by insertion of the lower ground stake element 18 into the ground penetrating tip 14. Alternatively, the lower ground stake element 18 may be attached to the ground-penetrating tip 14 so that a person may insert the combined structure into the ground with his or her hands by applying pressure to the lower ground stake element 18.

As indicated above, the lower ground stake element 18 carries a connector 24 at its upper end so that the intermediate ground stake element 20 may be inserted thereinto. As would be appreciated by those skilled in the art, however, the connector 24 need not be a separate element, as illustrated. Instead, the lower ground stake element 18 may be manufactured so that the connector 24 is an integral portion thereof. Needless to say, this arrangement may be reversed without departing from the scope of the present invention. If so, the connector 24 would be attached to or would be an integral part of the intermediate stake portion 20 so that the lower stake portion 18 may be inserted thereinto.

The wind indicator 10 includes a frame 26 onto which a web 28 is stretched. In one embodiment, the web 28 is a fabric. The fabric may be a weather-resistant woven material that resists fading when exposed, for long periods of time, to ultraviolet rays. For example, the web 28 may be Solar-Max™ fabric, which is the commercial name of a fabric manufactured by E. I. DuPont de Nemours and Company that resists fading when exposed to sunlight over a long period of time. Alternatively, the web 28 may be made from a nylon material, such as the type commonly used for parachutes. While a woven fabric may be used, it is also contemplated that the web 28 may be made of a non-woven material such as cellophane, plastic, wood, metal, glass, or any other suitable material. For the web 28, all that is required is a material (or a combination of materials) that may be incorporated onto at least a portion of the frame 26 so that the material (or materials) may assist in turning the body 30 of the wind indicator 10 by catching a passing breeze.

The web 28 need not cover every portion of the frame 26. Instead, the web 28 may cover any suitable portion of the frame 26 that is required to create the desired appearance of the wind indicator 10. As illustrated in FIG. 1, the desired appearance is a bird. Alternatively, as illustrated in FIG. 2, the desired appearance is a dolphin.

The body 30 of the wind indicator 10 incorporates a pivot 32, which is disposed on or attached to the frame 26. The pivot 32 connects the body 30 to the ground stake 12 so that the body 30 may rotate freely about the pivot axis 34, which is defined by the pivot 32 (and the ground stake 12). As illustrated in FIG. 1, the body 30 pivots in the direction indicated by arrow 36 about the pivot axis 34. The body 30 is designed to rotate 360 degrees around the pivot axis 34 without obstruction. However, as would be appreciated by those skilled in the art, the degree of rotational freedom of the body 30 may be limited to less than 360 degrees, if desired.

In one possible embodiment, the pivot 32 is disposed at a point on the body 30 where the weight of the front portion 38 of the body 30 and the weight of the rear portion 40 of the body 30 are roughly equivalent.

However, an equal distribution of weight between the front portion 38 and the rear portion 40 of the body 30 is not required for operation of the wind indicator 10 of the present invention. As part of the present invention, it is contemplated that the front portion 38 may weigh more or less than the rear portion 40. In such an instance, the pivot 32 remains capable of permitting the body 30 to turn about the pivot axis 34.

In the case where the weight is not evenly distributed between the front portion 38 and the rear portion 40, the pivot 32 may be disposed at a point on the body 30 that is known as the center of the effective sail area for the body 30. When positioned at the center of the effective sail area, the wind pressure is evenly distributed between the front portion 38 and the rear portion 40 of the body 30. Positioning the pivot 32 at center of the effective sail area on the wind indicator 10 helps to avoid oscillation of the wind indicator 10 when subjected to a passing breeze.

To ensure that the body 30 does not oscillate upon the application of a passing breeze, the pivot 32 is preferably disposed in front of the center of the effective sail area of the body 30. When the pivot 32 is so positioned, the likelihood that the body 30 will oscillate is greatly reduced or even eliminated.

It is known to the inventors of the present invention that, if the pivot 32 is positioned rearwardly of the center of the effective sail area for a wind indicator, the body 30 will become unstable in a passing breeze and will tend to oscillate (wiggle back and forth) as the body 30 attempts to reach an equilibrium with the wind. Placing the pivot 32 in front of or at least at the center of the effective sail area eliminates (or at least significantly reduces) to tendency for the body 30 to oscillate upon application of a passing breeze.

The frame 26 of the wind indicator 10 includes a spindle axis 42 on which a spindle 44 rotates. As illustrated in FIG. 1, the spindle 44 rotates freely about the spindle axis 42 (which has been extended in dotted-line format) in the directions indicated by the arrow 46. The spindle axis 42 may be a fiberglass rod. However, any other suitable material may be employed for the construction thereof.

The spindle 44 may have a number of vanes 48 attached to it. The vanes 48 are constructed and arranged to capture a breeze and translate wind movement into rotational movement of the spindle 44. As illustrated, and as discussed in greater detail below, the vanes 48 form a propeller shape to assist in translating a passing breeze into rotational movement. While a plurality of vanes 48 are shown in the two embodiments illustrated in FIGS. 1 and 2, it is believed that at least two vanes are required for rotation of the spindle 44. The exact number and shape of the vanes 48 is not critical to the operation of the wind indicator 10 of the present invention. Moreover, any number of vanes 48 greater than one is contemplated to fall within the scope of the present invention.

In the first embodiment of the wind indicator 10 of the present invention, the spindle 44 is located to the rear of the pivot 32. In this first embodiment, the vanes 48 are designed to look like the wings of a bird. Once inserted into the spindle 44, the vanes 48 are designed to establish a propeller shape so that they cause rotation of the spindle 44 when they capture a passing breeze.

Figure 3:
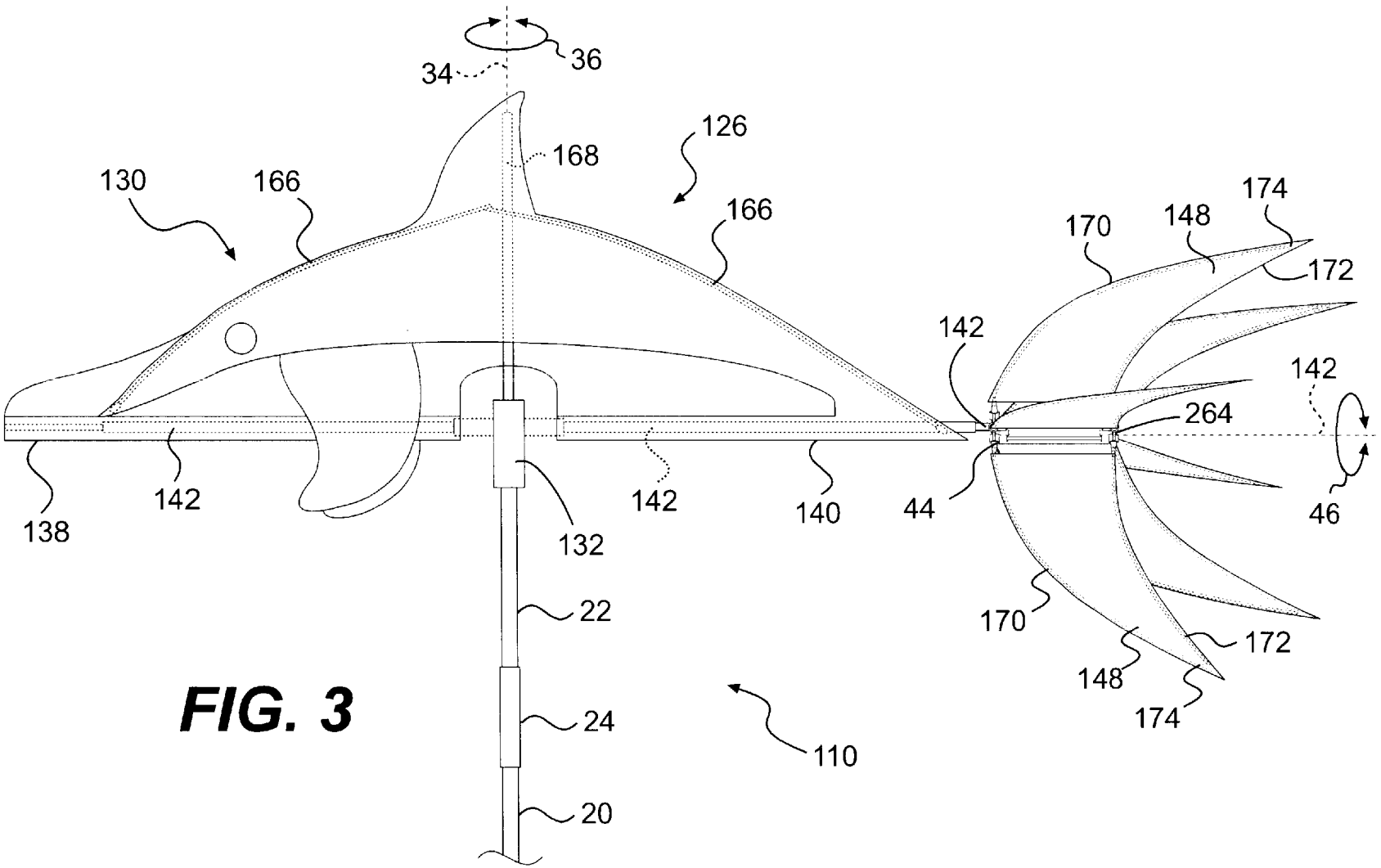
FIG. 3 is an enlarged side view of the embodiment of the wind indicator shown in FIG. 2.

The second embodiment of the present invention is designated 110 in FIG. 3. In this embodiment, the wind indicator 110 is in the shape of a dolphin. Many of the components of the wind indicator 110 are similar to the same components discussed in connection with the wind indicator 10. To the extent that the parts are the same, the same reference numerals are used.

The wind indicator 110 is designed to sit atop the ground stake 12 and rotate 360 degrees about the ground stake 12. As in the previous embodiment, the wind indicator 110 includes a frame 126 with a web 128 disposed on at least a portion of the frame 126. The web 128 may be made from a woven material that is stitched onto the frame 126, as in the previous example. As before, the web 128 may be a woven material that is resistant to degradation and fading when exposed to the sun and environment for extended periods of time. Of course, the web 128 may be made from any suitable material that may be stretched across or incorporated into the frame 126.

The frame 126 and the web 128 form the body 130 of the wind indicator 110. The body 130 is separable into two parts, a front portion 138 and a rear portion 140. As in the previous example, the front and rear portions 138, 140 straddle the ground-penetrating stake 12. As discussed above, the weights of the front and rear portions 138, 140 need not be equally distributed on either side of the stake 12 for operation of the present invention.

In one embodiment, the frame 126 includes a pivot 132, which permits the body 130 to rotate 360 degrees (indicated by arrow 36) around the pivot axis 34. The frame also includes a spindle axis 142, on which the spindle 44 is disposed. As in the first example, the spindle 44 may rotate 360 degrees around the spindle axis 142 (in the direction of the arrow 46). The spindle 44 includes a plurality of vanes 148 that are designed to capture a passing breeze and translate wind movement into rotational motion. As before, the pivot 132 may be positioned in front of the effective sail area for the body 130 to minimize oscillation of the body 130 when capturing a passing breeze. As in the first example, the spindle 44 is located in the rear portion 140 of the wind indicator 110.

Aside from their overall appearance, a primary distinction between the two wind indicators 10, 110 is the location of the spindle 44. For the wind indicator 10, the spindle 44 is positioned immediately behind the pivot 32. For the wind indicator 110, the spindle 44 is positioned at the rear of the rear portion 140, a further distance from the pivot 132 than in wind indicator 10. The exact positioning of the spindle 44 is not critical to the operation of the present invention.

The present invention not only is intended to encompass the position of the spindle 44 at the rear portion 40, 140 of the wind indicator 10, 110. It is also contemplated that the spindle 44 may be position in the front portion 38, 138 of the wind indicator 10, 110. In other words, the present invention, as defined by the claims appended hereto, is intended to encompass any design, regardless of the location of the spindle 44.

FIG. 3 presents an enlarged side view of the wind indicator 110 illustrated in FIG. 2. FIG. 3 is particularly helpful for understanding the construction of the frame 126 that supports the web 128. While the following discussion will detail the construction of the frame 126, it should be noted at the outset that the shape and construction of the frame 126 is specific for the animal shape illustrated (in this case, a dolphin). As would be appreciated by those skilled in the art, the shape of the frame 26, 126 will differ according to the design applied to the wind indicator 10, 110.

The frame 126 includes the spindle axis 142, which is contemplated to be a supporting, cylindrically-shaped dowel running the length of the body 130. The spindle axis 142 may be a single, unitary construction or it may comprise a number of elements connected together. Regardless of the exact construction of the spindle axis 142, all that is required for the spindle axis is that it provide a smooth, circular surface for rotatably supporting the spindle 44. This assures that the spindle can rotate about the spindle axis 142. As in the previous example, the spindle axis 142 may be constructed from fiberglass, but any other suitable material may be used therefor.

Figure 12:
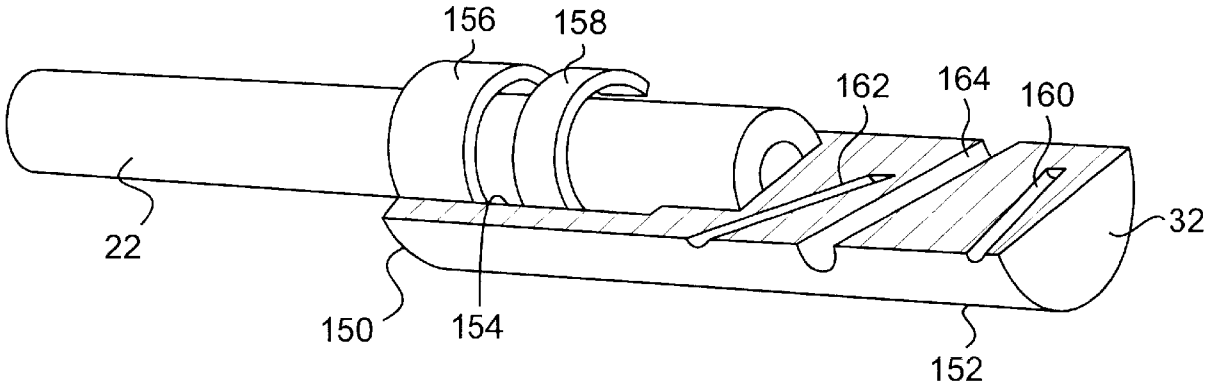
FIG. 12 is a perspective, partial cross-sectional view of the pivot of the present invention.
Figure 13:
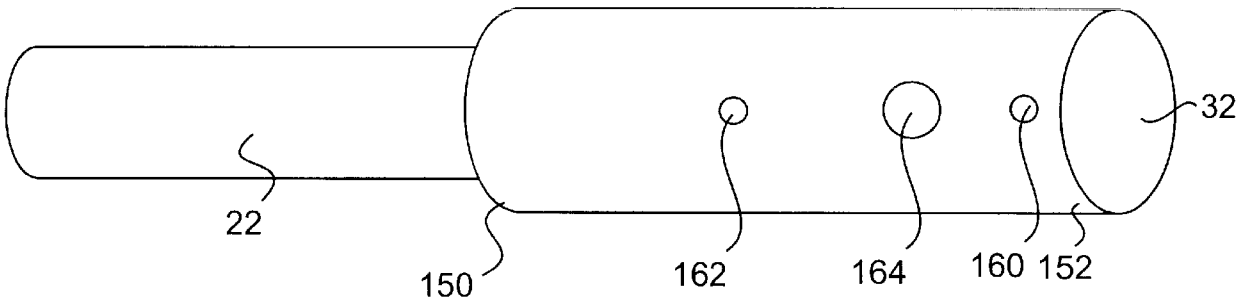
FIG. 13 is a side view of the pivot of the present invention illustrated in FIG. 12.
Figure 14:
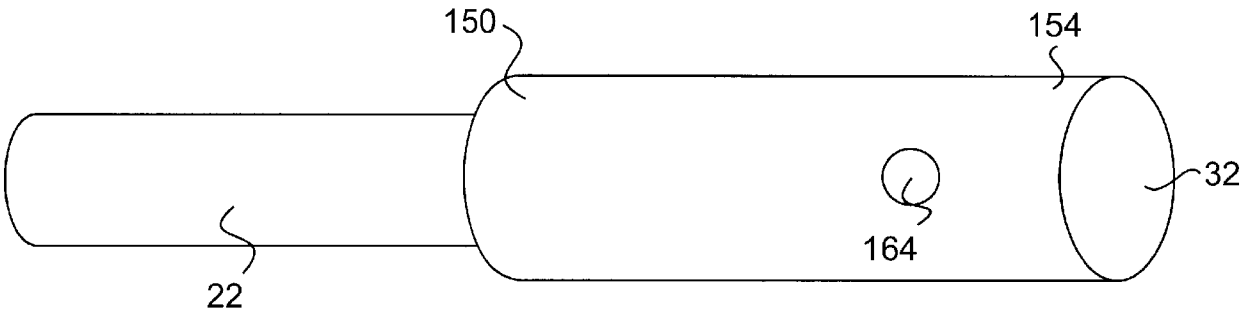
FIG. 14 is a side view of the pivot of the present invention shown in FIG. 12, illustrating the side opposite to that shown in FIG. 13.

Returning to the embodiment illustrated in FIG. 1, the pivot 32 will now be described. The pivot 32 is connected to the spindle axis 42. The details of the pivot 32 are shown in FIGS. 12–14. The pivot 32 has a lower end 150 and an upper end 152. At its lower end 150, the pivot 32 has a central hole 154 into which the upper ground stake element 22 is inserted, as shown in FIG. 12. The central hole 154 may be provided with a collar 156, which engages a collar 158 that is attached to the upper ground stake element 22. The pivot 32, the upper ground stake element 22, and the collars 156, 158 are all made from a plastic material. As would be appreciated by those skilled in the art, however, any other suitable material, such as nylon, a composite material, or even metal may be substituted therefor without departing from the scope of the present invention.

The construction of the collars 156, 158 offers one advantage to the construction of the present invention that is not present in the prior art. In particular, the collars 156, 158 are designed to interfere with one another to prevent the body 30, 130 from becoming easily dislodged from the ground stake 12. In fact, in one embodiment, the collars 156, 158 offer so great a resistance to disengagement of the body 30, 130 from the ground stake 12 that they do not permit separation of the body 30, 130 from the ground stake, once assembled. Of course, as would be appreciated by those skilled in the art, the collars 156, 158 may be designed so that the body 30, 130 is separable from the ground stake 12, if desired.

The pivot 32 that is illustrated in FIGS. 12–14 is specifically designed for the wind indicator 10. In particular, the pivot 32 includes an upper hole 160 and a lower hole 162, both of which extend a partial distance into the body of the pivot 32. The pivot 32 also includes a through hole 164 that extends completely through the body of the pivot. As will become apparent from the discussion that follows, the positioning of the holes 160, 162, 164 in the pivot 32 are not critical to the present invention. However, it is contemplated that practice of the present invention will entail the incorporation of at least one hole in the pivot 32 so that the frame 26, 126 may be attached thereto.

Referring now to FIGS. 1 and 12–14, the through hole 164 accepts the forward end of the spindle axis 42 therein. In this manner, the rear portion 40 of the wind indicator 10 is attached to the pivot 32. As illustrated, the through hole 164 extends completely through the body of the pivot 32. Such a construction ensures that the spindle axis 42 is properly inserted into the pivot 32. It is contemplated that the spindle axis 42 is held in place in through hole 164 by a frictional fit between the two elements. However, as would be appreciated by those skilled in the art, the spindle axis 42 may be held in the through hole 164 by an adhesive or other suitable attachment means (such as a fastener or the like).

The front portion 38 of the body 30 of the wind indicator 10 is coupled to the pivot 32 using one or both of the upper and lower holes 160, 162. In the embodiment illustrated, the web 28 that forms the front portion 38 (i.e., the head of the bird) is supported on a curved support wire 66. One end of the support wire 66, which is visible in FIG. 1, is inserted into the upper hole 160. If provided, a second end of the support wire 66 (which is not visible in FIG. 1) may be inserted into the lower hole 162.

Where applicable, it is suggested that the support wire 66 be held in place in the upper and lower holes 160, 162 by a suitable adhesive. However, as would be appreciated by those skilled in the art, the support wire 66 may be held in place by a frictional fit between the ends of the wire 66 and the interior surfaces of the upper and lower holes 160, 162. Moreover, the support wire 66 need not be a single wire but, in an alternative embodiment, could be two or more separate wires. In addition, the wire 66 need not be made from metal. To the contrary, in one embodiment of the present invention, the wire 66 is a fiberglass rod.

While upper and lower holes 160, 162 are illustrated in FIGS. 12 and 13, those skilled in the art will readily appreciate that a greater or fewer number of holes may be provide depending upon the shape of the elements attached to the pivot 32. The number of holes 160, 162, therefore, need not be two in number. The present invention also encompasses embodiments have a greater or fewer number, depending upon the shape and size of the body 30 supported thereby.

Additional elements of the present invention will now be discussed in connection with the embodiment illustrated in FIGS. 2 and 3. While the following discussion focuses on the specific embodiment illustrated in FIGS. 2 and 3, it should be noted that the present invention is not limited solely to the embodiment illustrated and described. To the contrary, the frame 126 may take any shape to support whatever ornamental design is applied to a wind indicator 110 following the teachings of the present invention.

The frame 126 includes a spindle axis 142, which extends along the length of the body 130 of the wind indicator 110. The spindle axis 142 extends through a hole (not shown) that extends completely through the body of the pivot 132 (much like the through hole 164 shown in FIGS. 12–14). The spindle axis 142 may be affixed to the pivot 132 by an adhesive or other suitable means, if desired. Where an adhesive is used, the preferred adhesive is cyanoacrylate, which is commonly known by its trademark name "Superglue." While adhesive is preferred, it is also contemplated that the spindle axis 142 may engage the pivot 132 simply with a frictional fit.

The frame 126 also includes one or more support wires 166 that extend upwardly from the spindle axis 142. In the embodiment illustrated, a support post 168 is also shown. The support post 168 extends upwardly from the top of the pivot 132. The support post frictionally engages a hole (not shown) that is disposed in the top of the pivot 132. The support post 168 extends upwardly to form the vertical support for the frame 126. In the embodiment illustrated in FIGS. 2 and 3, the support wires 166 are not connected to the spindle axis 142 or the support post 168 because this is not necessary. The web 128 that extends over the frame elements 142, 166, 168 holds the individual frame elements 142, 166, 168 in positional relation with respect to one another. Of course, as would be appreciated by those skilled in the art the support post 168 and support wires 166 may be connected to one another to provide additional, rigid support for the web 128.

As illustrated, the web 128 is sewn onto the frame 126 so that the frame 126 provides support therefor. However, the web 128 need not be sewn onto the frame 126. To the contrary, the web 128 may be affixed to the frame 126 through any other suitable means known to those skilled in the art. For example, the web 128 may be glued to the frame 126. Alternatively, if the material that comprises the web 128 permits, the web 128 may be heat-sealed onto the frame 126. Other alternative attachment means are also contemplated to fall within the scope of the present invention, as would be appreciated by those skilled in the art.

As illustrated in FIG. 3, the vanes 148 are kept rigid by support wires 170, 172. In the embodiment illustrated, the support wires 170 form the leading edge of the vanes 148 and the support wires 172 form the trailing edge. The two support wires 170, 172 are incorporated into the web 128 that is stretched thereover to form the vanes 148. Since the web 128 forms part of the structure of the vanes 148, the support wires 170, 172 do not need to be connected to one another at their respective tips 174. Of course, as would be appreciated by those skilled in the art, depending on the design and the material selected for the web 128, the support wires 170, 172 may be connected to one another to provide additional rigidity to the structure of the vanes 148.

The details of the spindle 44 will now be described in connection with FIGS. 4–7.

Figure 4:
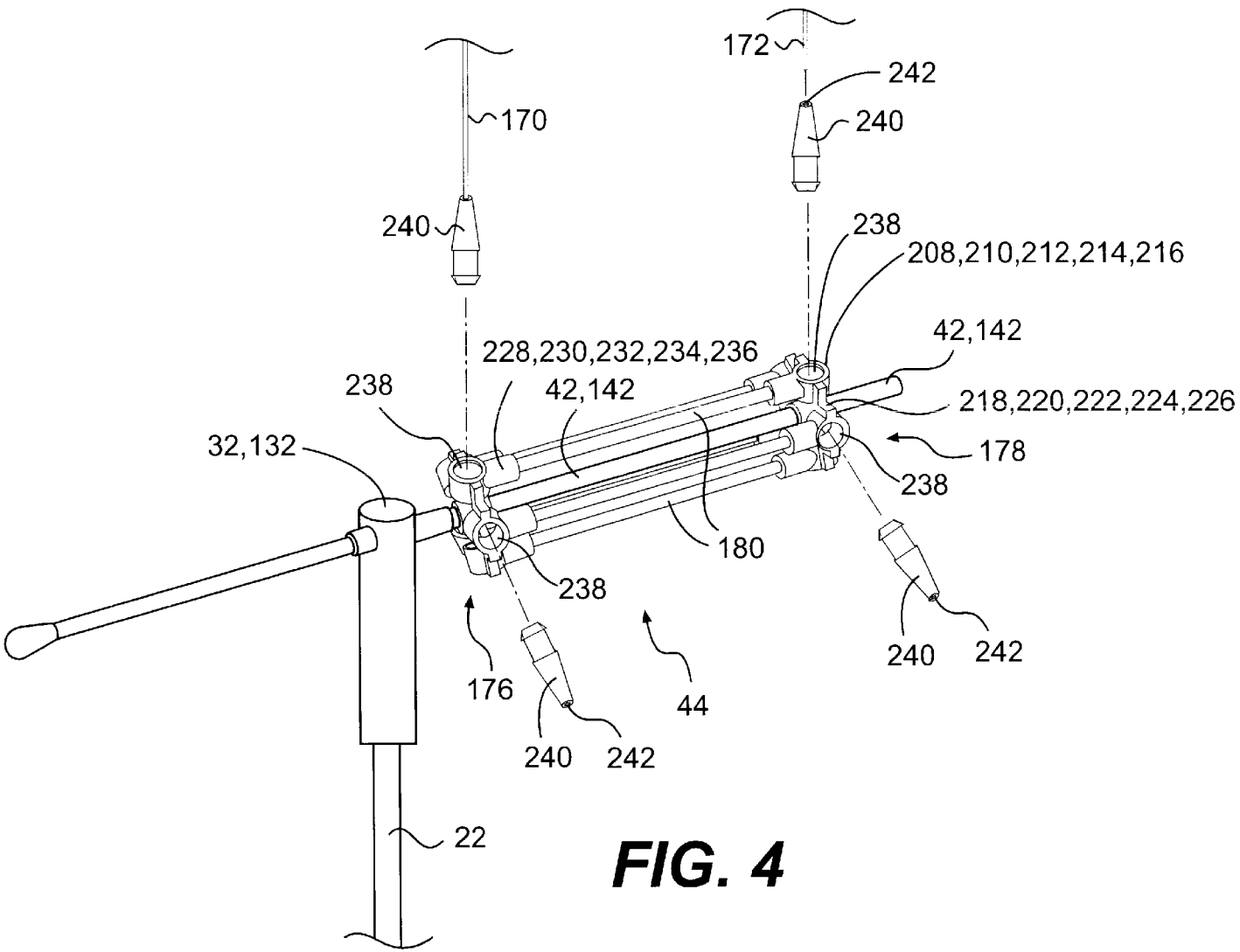
FIG. 4 is a perspective illustration of a portion of one possible frame of the present invention, showing in detail the spindle and spindle axis.

A perspective detail of the spindle 44 is illustrated in FIG. 4. The spindle 44 is shown disposed on the spindle axis 42, 142, which extends through the pivot 32, 132. The particular arrangement of the spindle axis 42, 142 and the pivot 32, 132 is not exactly the same as the arrangement illustrated with respect to the first and second embodiments discussed above but has been simplified for purposes of this discussion. As those skilled in the art will appreciate (and as discussed above), the exact details of the construction are not critical to the operation of the wind indicator 10, 110 of the present invention. Moreover, it is expected that these structures will differ depending upon the design applied thereto.

In the embodiment illustrated, the spindle 44 is made up of several components, a first hub 176, a second hub 178, and at least one element 180 connecting the first hub 176 to the second hub 178. In the embodiment illustrated throughout the drawings, the spindle 44 includes five elements 180 that connect the first hub 176 to the second hub 178. However, as would be appreciated by those skilled in the art, all that is required to connect the hubs 176, 178 is a single connecting element 180. Obviously, a greater number of connecting elements 180 may be used. It is contemplated that the connecting elements 180 are arranged so that they are evenly balanced around the periphery of the spindle 44 to facilitate rotation of the spindle 44.

As illustrated, the spindle 44 includes five connecting elements 180. In a second embodiment, which is not illustrated, three connecting elements 180 extend between the hubs 176, 178. As indicated, any number greater than one of the connecting elements 180 is contemplated to fall within the scope of the present invention. In fact, extending the concept to its extreme, a solid cylinder could extend between the hubs 176, 178. A solid cylinder would act as a single connecting element between the hubs. The solid cylinder is essentially the physical embodiment of a surface generated by an infinite number of connecting elements between the hubs 176, 178.

Alternatively, the hubs 176, 178 need not be connected to one another directly via the connecting elements 180. Instead, the hubs 176, 178 may be connected indirectly through the vanes 48, 148. In such a case, the connecting elements could extend between the support wires 170, 172 that are incorporated into the vanes 48, 148. In such a case, at the time that the vanes 48, 148 are connected to the hubs 176, 178 the connecting elements 180 will hold the hubs 176, 178 in positional relationship with respect to one another. Alternatively, the vanes 48, 148 themselves may be made so that they are rigid enough to act as connecting elements. In one possible embodiment, the vanes could be constructed from a rigid material or a material that has been treated so that it is rigid enough to act as a connecting element without further structural components being incorporated therein.

In the embodiment illustrated, the connecting elements 180 have a circular cross-section. However, as would be appreciated by those skilled in the art, the connecting elements 180 may have any suitable shape. For example, the connecting elements 180 may have a triangular, square, rectangular, polygonal, elliptical, or ovoid shape. As would be appreciated by those skilled in the art, the exact shape is irrelevant to the present invention. Moreover, any suitable shape is intended to fall within the scope of the present invention.

The connecting elements 180 maintain the first and second hubs 176, 178 in positional relationship with respect to one another. This is relevant to the construction of the wind indicator 10, 110 because the vanes 48, 148 are stretched between the hubs 176, 178 to establish a propeller shape that may be driven by wind movements.

Figure 5:
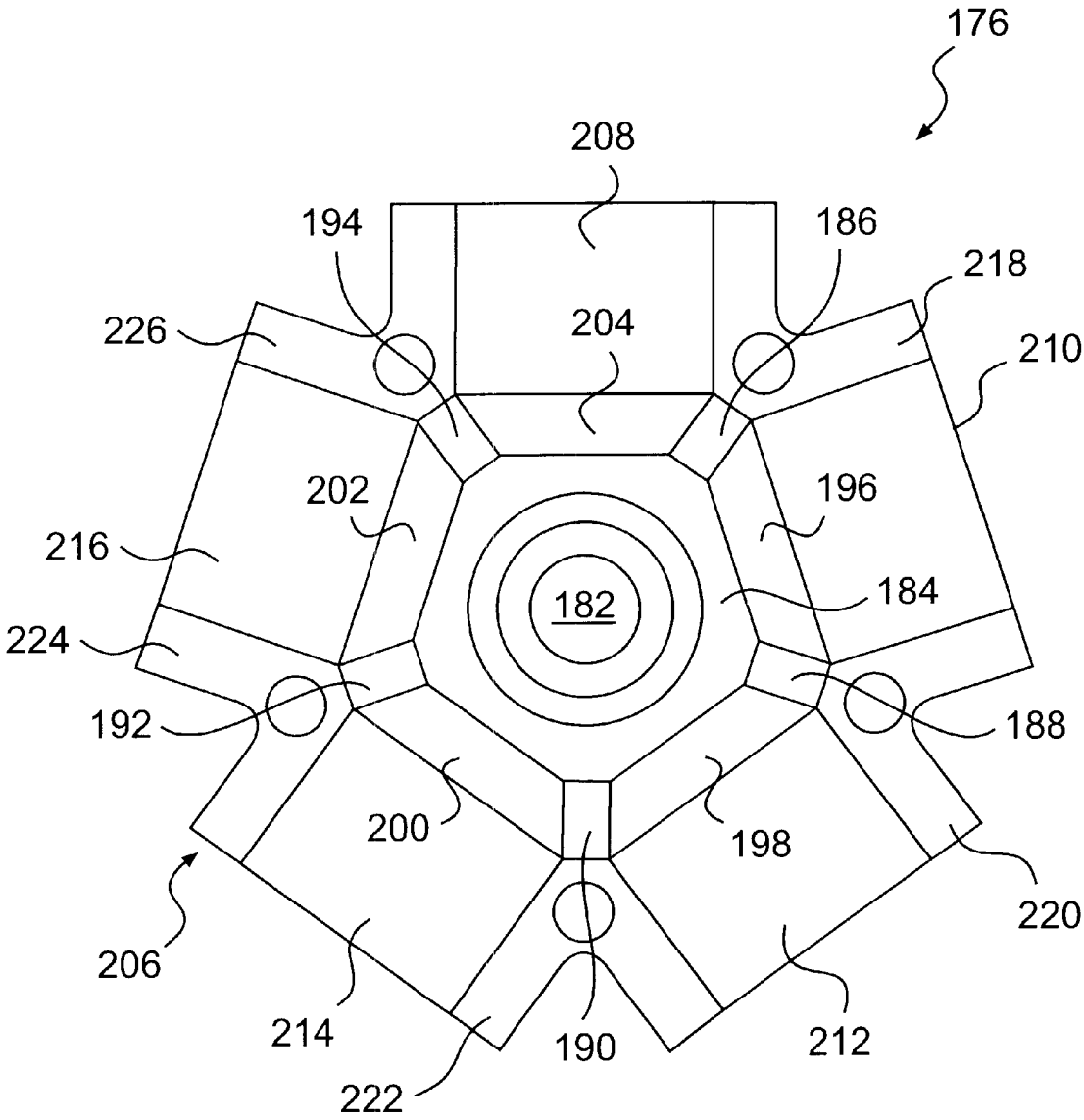
FIG. 5 is a front end view of one of the hubs of the spindle forming a part of the present invention.
Figure 6:
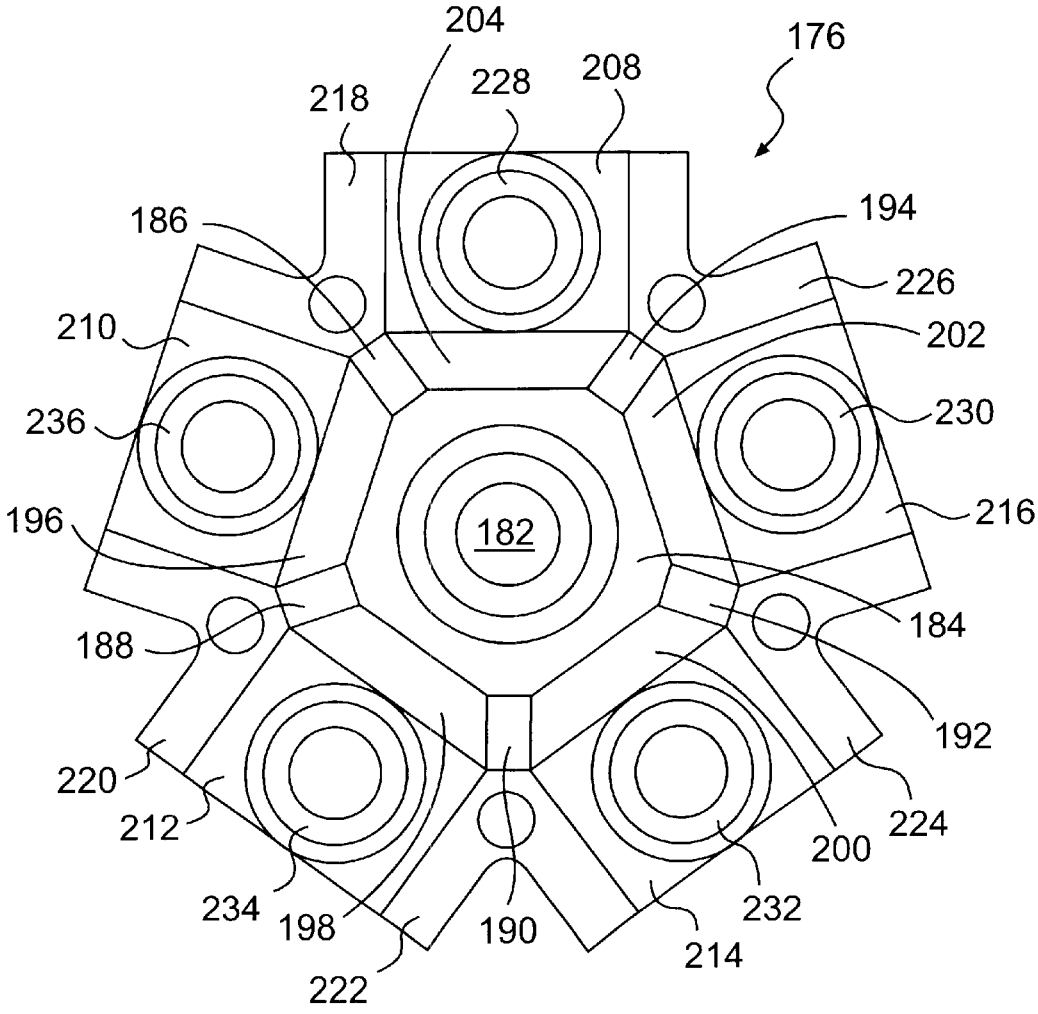
FIG. 6 is a rear end view of the hub illustrated in FIG. 5.
Figure 7:
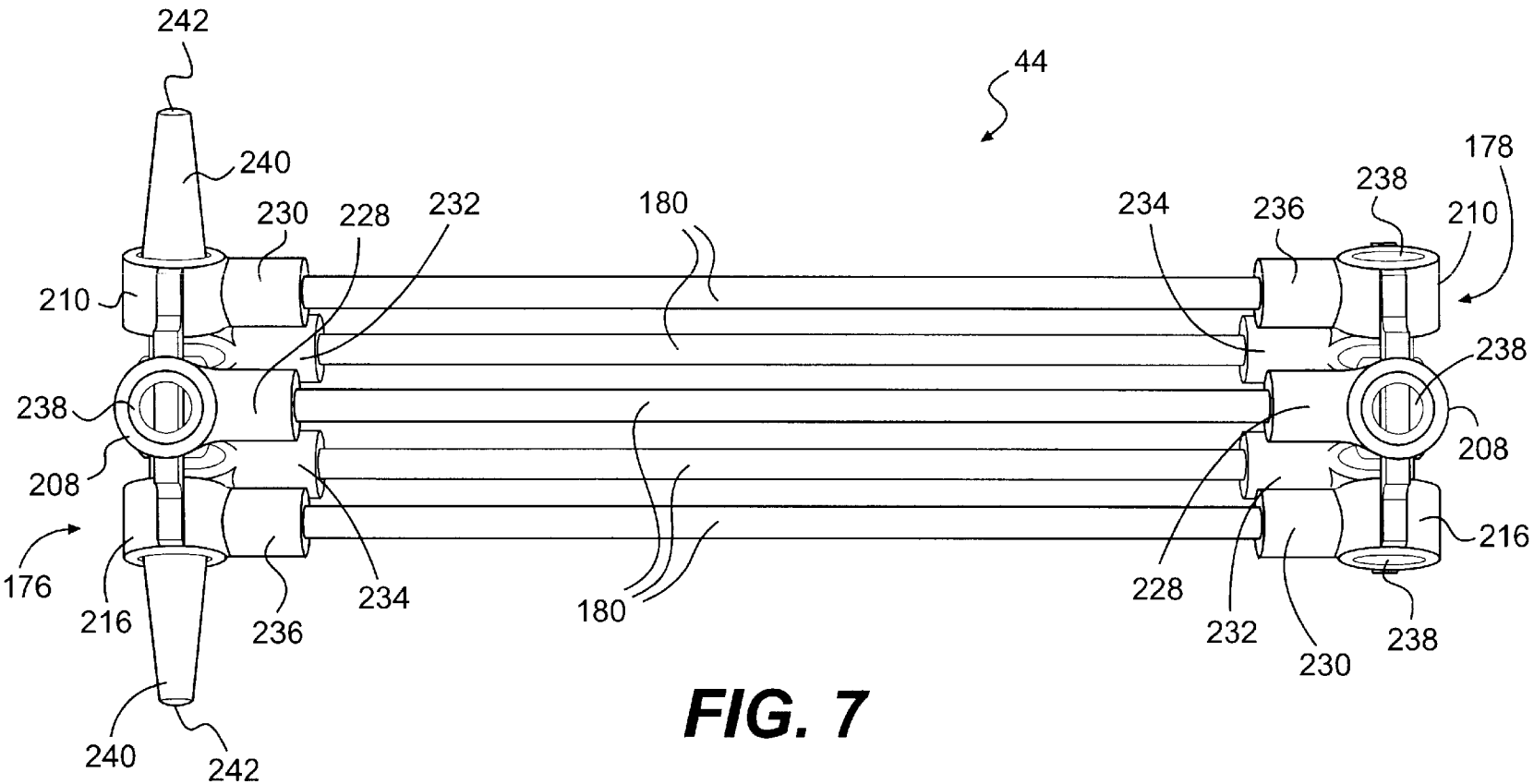
FIG. 7 is a top view of the spindle of the wind indicator of the present invention, which is shown in perspective in FIG. 4.

A front end view of the first hub 176 is illustrated in FIG. 5 with the rear end view being illustrated in FIG. 6. The first hub 176 includes a central hole 182. The spindle axis 42, 142 passes through the central hole 182. In the embodiment illustrated, the central hole 182 is surrounded by a central body portion 184, which is pentagon-shaped. It should be noted that the pentagonal shape of the central body portion 184 is not required to practice the present invention. To the contrary, the pentagonal shape is merely one embodiment contemplated for use with the present invention. As would be appreciated by those skilled in the art, the central body 184 may take any suitable shape.

Because the illustrated body portion 184 has a pentagonal shape, five supports 186, 188, 190, 192, 194 extend outwardly to an outer, ring-shaped vane support structure 206. The five supports 186, 188, 190, 192, 194 are separated from one another by trapezoidally-shaped holes 196, 198, 200, 202, 204, which extend all of the way through the first hub 176. The supports 186, 188, 190, 192, 194 extend from the central body portion 184 to the vane support structure 206.

The vane support structure 206 is made up of five separate vane support receiving elements 208, 210, 212, 214, 216 that are connected to one another via v-shaped connectors 218, 220, 222, 224, 226.

As indicated above, in one embodiment of the present invention, there are five support receiving elements 208, 220, 222, 224, and 226. This means that the spindle 44 will support five vanes 148. While this is the suggested number of support receiving elements, it should be noted that only two support receiving elements are preferred to practice the present invention. Any number greater than one is believed to be sufficient, when provided with vanes 148, to cause the spindle 44 to rotate upon application of a passing breeze.

In the embodiment illustrated, the first and second hubs 176, 178 are one-piece, integrated components. Each of the hubs 176, 178 are made from a plastic material. However, as would be appreciated by those skilled in the art, the hubs 176, 178 may be constructed from any suitable material including, for example, resin, metal, or a composite material. Moreover, while a single material is contemplated for the construction of the hubs 176, 178, the hubs 176, 178 may be made from a combination of several different materials. For example, it is contemplated that the central body portion 184 may be provided with a bushing or bearing around the central hole 182 to facilitate rotational motion of the spindle 44.

The connecting elements 180 extend between the element holding portions 228, 230, 232, 234, 236 that extend rearwardly from the rear side of the first hub 176 and extend forwardly from the front surface of the second hub 178. The holding portions 228, 230, 232, 234, 236 are cylindrically-shaped protrusions that project from the appropriate surfaces of the hubs 176, 178. The holding portions 228, 230, 232, 234, 236 are integrally formed as a part of the hubs 176, 178. Alternatively, the holding portions 228, 230, 232, 234, 236 may be connected to the hubs via a suitable connector. The connecting elements 180 are fastened into the holding portions 228, 230, 232, 234, 236 by a suitable adhesive. Alternatively, the connecting elements 180 might be screw-fitted into the holding portions 228, 230, 232, 234, 236. As would be understood to those skilled in the art, any suitable connector may be used to attach the connecting elements 180 between the hubs 176, 178.

The holding portions 228, 230, 232, 234, 236 are cylindrically-shaped protrusions that extend from the rear surface of the hub 176 or the front surface of the hub 178. While this is the contemplated shape, it is noted that the shape of these portions is not essential for the operation of the present invention. The holding portions 228, 230, 232, 234, 236 could take any suitable shape such as triangular, square, rectangular, polygonal, elliptical, or ovoid. In the example illustrated, the shape of the holding portions 228, 230, 232, 234, 236 coincides with the cross-sectional shape of the connecting elements 180. However, this is also not required to practice the present invention, as would be appreciated by those skilled in the art.

Each of the vane support receiving elements 208, 210, 212, 214, 216 is provided with a hole 238 extending radially therethrough. The holes 238 open into the trapezoidally-shaped holes 196, 198, 200, 202, 204 that extend longitudinally through the hubs 176, 178. The holes 238 are sized to accommodate vane supports 240 therein. In one embodiment, the vane supports 240 are conically-shaped elements with a hole 242 in the tip end. The hole 242 is sized to accept one of the vane support wires 170, 172, as illustrated in FIG. 4. The vane support wires 170, 172 are fixed in the holes 242 with a suitable adhesive. However, the vane support wires 170, 172 may be fixed in the holes 242 via a frictional fit or other suitable attachment means.

Figure 8:
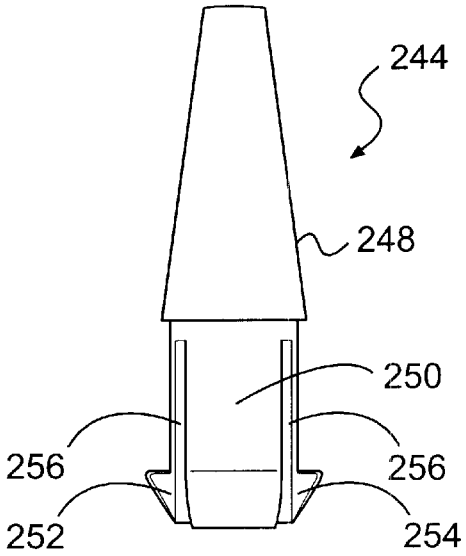
FIG. 8 is a side view of a first embodiment of a vane support that inserts into the spindle of the present invention.
Figure 9:
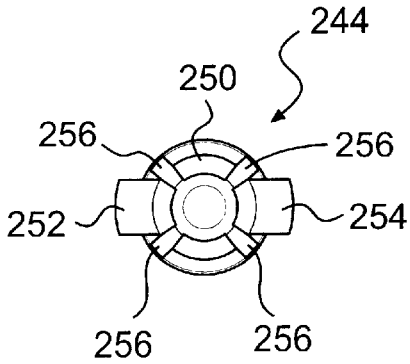
FIG. 9 is a bottom view of the vane support illustrated in FIG. 8.
Figure 11:
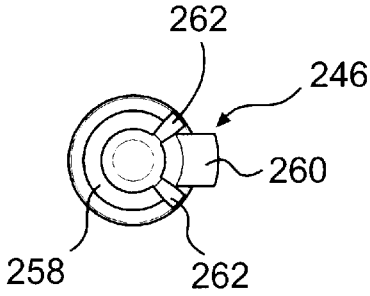
FIG. 11 is a bottom view of the vane support illustrated in FIG. 10.

FIGS. 8–11 illustrate two alternate embodiments for the vane support elements 240. The first embodiment, which is called the double-tab vane support 244 is illustrated in FIGS. 8 and 9. The second embodiment, called the single-tab vane support 246, is illustrated in FIGS. 10–11.

As shown in FIGS. 8 and 9, the double-tab vane support includes an upper, conical section 248 and a lower, cylindrical section 250. The lower cylindrical section 250 includes two tabs 252, 254, which are disposed on opposite sides of the lower section 250 from one another. The tabs 252, 254 are separated from the lower section 250 by slits 256, which sandwich the tabs 252, 254 between them.

FIGS. 10–11 illustrate the single-tab vane support 246. Like the double-tab vane support 244, the single-tab vane support 246 includes a conically-shaped upper section 248. The single-tab vane support 246 also includes a cylindrically-shaped lower portion 258. As the name suggests, the single-tab vane support 246 includes only one tab 260, which is separated from the cylindrical section 258 by two slits 262.

The construction of the vane supports 244, 246 is designed to hold the vane 48 in place on the spinner 44 despite prolonged environmental exposure. In particular, the lower, cylindrically-shaped sections 250, 258 are inserted into the holes 238 in the spindle 44. The tabs 252, 254, 260 are flexible and constrict inwardly when the vane support 244, 246 is inserted into the hole 238. Once the tab 252, 254, 260 clears the bottom part of the hole 238, the tabs 252, 254, 260 expand outwardly to hold the vane support 244, 246 in place on the spindle 44. In particular, the tabs 252; 254, 260 expand outwardly in one of the trapezoidal holes 196, 198, 200, 202, 204 in the hubs 176, 178.

The vane supports 240, whether the double-tab or single-tab constructions 244, 246 advantageously hold the vanes 148 in the spindle 44. The vane supports 240 also facilitate assembly of the wind indicator 10, 110 because they permit insertion of the vanes 48, 148 into the spindle without the need for special tools. In the illustrated embodiment of the present invention, the vane supports 240 are made of plastic, but any other suitable material may be used, as would be appreciated by those skilled in the art.

While the vane supports 240 are illustrated as male elements that fit into the holes 238, which are female, the opposite orientation is possible. In other words, the double-tab or single-tab male ends may be connected to the spindle 44 and the vane supports 240 may include female holes to receive the male connectors.

Figure 15:
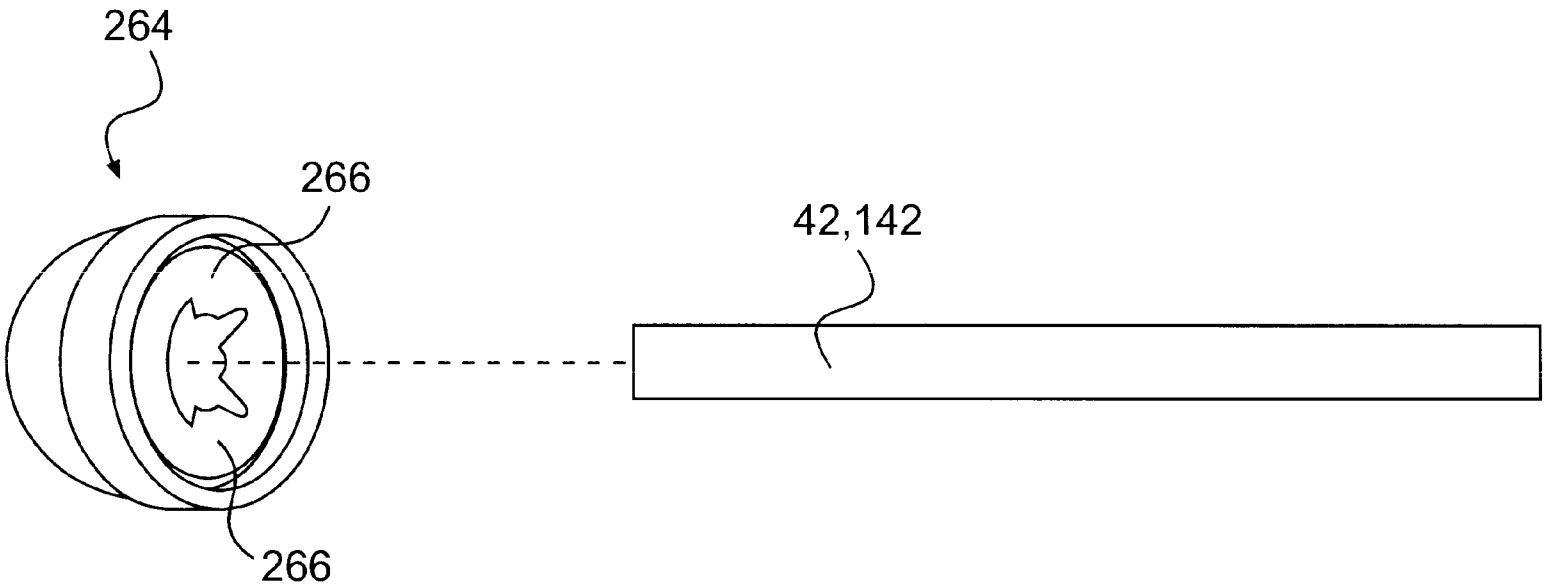
FIG. 15 is a perspective illustration of the spindle retainer of the present invention.

FIG. 15 illustrates an acorn hub 264, which attaches to the end of the spindle axis 42, 142 by a press fit. The acorn hub 264 is specifically designed for use with the wind indicator 110 to hold the spindle 44 onto the spindle axis 142. However, the acorn hub 264 may also be used with the wind indicator 10. In that embodiment, the acorn hub 264 would hold both the spindle 44 and the rear portion 40 of the body 30 onto the spindle axis 42.

The acorn hub 264 essentially is a rounded cap with several gripping structures 266 on an interior portion thereof. The gripping structures 266 are flexible and bend inwardly upon insertion of the spindle axis 42, 142 thereinto. The gripping structures 266 provide a frictional fit between the acorn hub 264 and the spindle axis 42, 142. The frictional fit is so strong that the acorn hub 264, in one embodiment of the present invention, is not easily dislodged from the spindle axis 42, 142. However, the acorn hub 264 may be designed so that the gripping structures 266 permit removal of the acorn hub 264 when it is desired to remove the spindle 44 from the spindle axis 42, 142.

The acorn hub 264 may be made entirely of a plastic material, but any other suitable material may be substituted therefor. In the embodiment illustrated, for example, the outer portion of the acorn hub 264 is made of plastic while the gripping structures 266 are made from metal.

One advantage to using the acorn hub 264 is that the hub 264 may be attached to the end of the spindle axis 42, 142 regardless of its cross-sectional shape. Moreover, the acorn hub 264 may be affixed to the spindle axis 42, 142 without the use of glue, which adds manufacturing expense and the potential for glue to fall onto parts of the body 30, 130 of the wind indicator 10, 110. As it turns out, the gripping structures 266 tend to provide a more secure attachment than glue between the acorn hub 264 to the spindle axis 42, 142.

Figure 16:
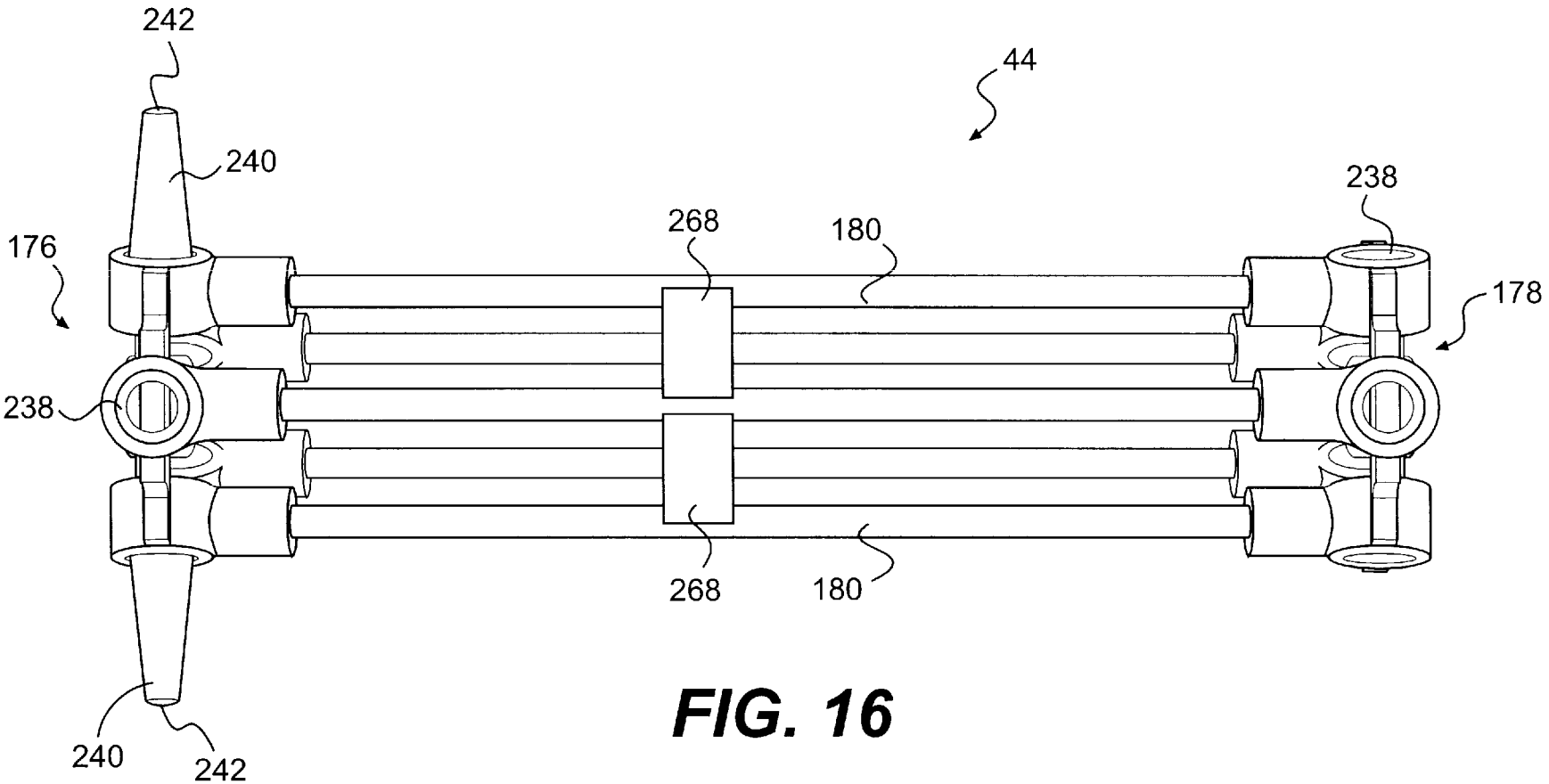
FIG. 16 is a side view of an alternative embodiment of the spindle of the present invention, showing sound generating devices attached thereto.

FIG. 16 illustrates an alternative embodiment of the spindle 44. In this embodiment, sound-generating devices 268 are coupled between the connecting elements 180. The sound-generating devices 268 generate noise when the spindle 44 rotates. In one embodiment, the sound-generating devices 268 may generate a sound audible to humans. In another embodiment, the sound-generating devices 268 may generate a sound audible to small animals only to discourage such animals, such as rodents, from approaching the area in which the wind indicator 10, 110 is placed. Alternatively, the sound-generating devices 268 may be rotatably attached to the spindle axis 42, 142 and may be operationally connected to the spindle 44 for rotation thereby.

In FIG. 16, the sound-generating devices 268 are contemplated to be whistle-generators that easily attach between two of the connecting elements 180. However, it is contemplated that the sound generating device 268 may be a flexible member attached to the spindle axis 142 that extends outwardly to touch the connecting elements 180. In this alternate embodiment (not shown), the flexible member "clicks" when it touches each of the connecting elements 180 as they rotate upon application of a passing breeze. This alternative embodiment, therefore, operates in much the same manner as a chance gaming wheel, where a flexible pointer impacts with each passing post before coming to rest between two adjacent posts.

The operation of the wind indicator 10, 110 of the present invention will now be discussed. The body 30, 130 of the wind indicator 10, 110 is rotationally disposed on the ground stake 12 via the pivot 32, 132. As a result, the body 30, 130 is free to rotate 360 degrees about the pivot axis 34. Accordingly, when a breeze impacts the web 28, 128 stretched across the frame 26, 126, the body 30, 130 will rotate to expose the smallest aspect of the wind indicator 10, 110 to the wind. In other words, when a breeze passes over the wind indicator 10, 110, the wind indicator 10, 110 will rotate into the breeze.

The spindle 44 is rotatably disposed on the spindle axis 42, 142. The vanes 48, 148 that are connected to the spindle 44 are designed to cause the spindle to rotate in one direction (i.e., clockwise or counterclockwise). When a breeze passes over the wind indicator 10, 110, the body 30, 130 turns into the breeze and the spindle 44 rotates. In the case of the wind indicator 10, since the vanes 48 are in the shape of wings, a breeze causes the vanes 48 to rotate, giving the appearance of a flying bird. For the wind indicator 110, a breeze causes the vanes 148 to move, giving the appearance of a swimming dolphin.

One advantage of the construction of the spindle 44 of the present invention over the prior art (e.g., the wind indicator of U.S. Pat. No. 6,206,747) lies in the construction of the hubs 176, 178. In particular, the hubs 176, 178 of the spindle 44 of the present invention touch the spindle axis 44 at two discrete points along the spindle axis 42, 142. This reduces the frictional contact between the spindle 44 and the spindle axis 42, 142 so that the spindle 44 is more likely to rotate given a smaller force from a weaker breeze. In other words, the spindle 44 of the present invention is more apt to rotate in a lesser-strength breeze that the apparatus shown and described in the '747 patent.

Another advantage offered by the construction of the spindle 44 of the present invention over the construction illustrated and described in the '747 patent also concerns the minimal contact between the spindle 44 and the spindle axis 42, 142. Because the spindle has so little contact with the spindle axis 42, 142, the central holes 182 are less likely to be fouled after prolonged exposure to the environment. Should they become fouled (e.g., after a rain), the spindle 44 may be removed from the spindle axis, and the central holes 182 may be cleaned easily.

Still another advantage of the present invention over that of the '747 patent lies in the displacement of the connecting elements 180 a predetermined distance from the spindle axis 42, 142. Not only does this construction permit the addition of sound-generating device 268 thereon, it also moves the mass of the spindle 44 away from the spindle axis 42, 142. This creates a mass of inertia that is disposed apart from the spindle axis 42, 142, which helps to impart a greater rotational momentum when the spindle 44 rotates. This helps to keep the spindle 44 spinning, even after the breeze has stopped (before the next breeze imparts additional rotational motion to the spindle 44).

In addition, the spinner 44 of the present invention permits bearings or bushing to be inserted into the central holes 182 to further facilitate spinning of the spindle 44. This is not possible with the wind indicator illustrated and described in the '747 patent because the rotating member in that device does not have holes that may readily accept bearings or bushings.

Figure 17:
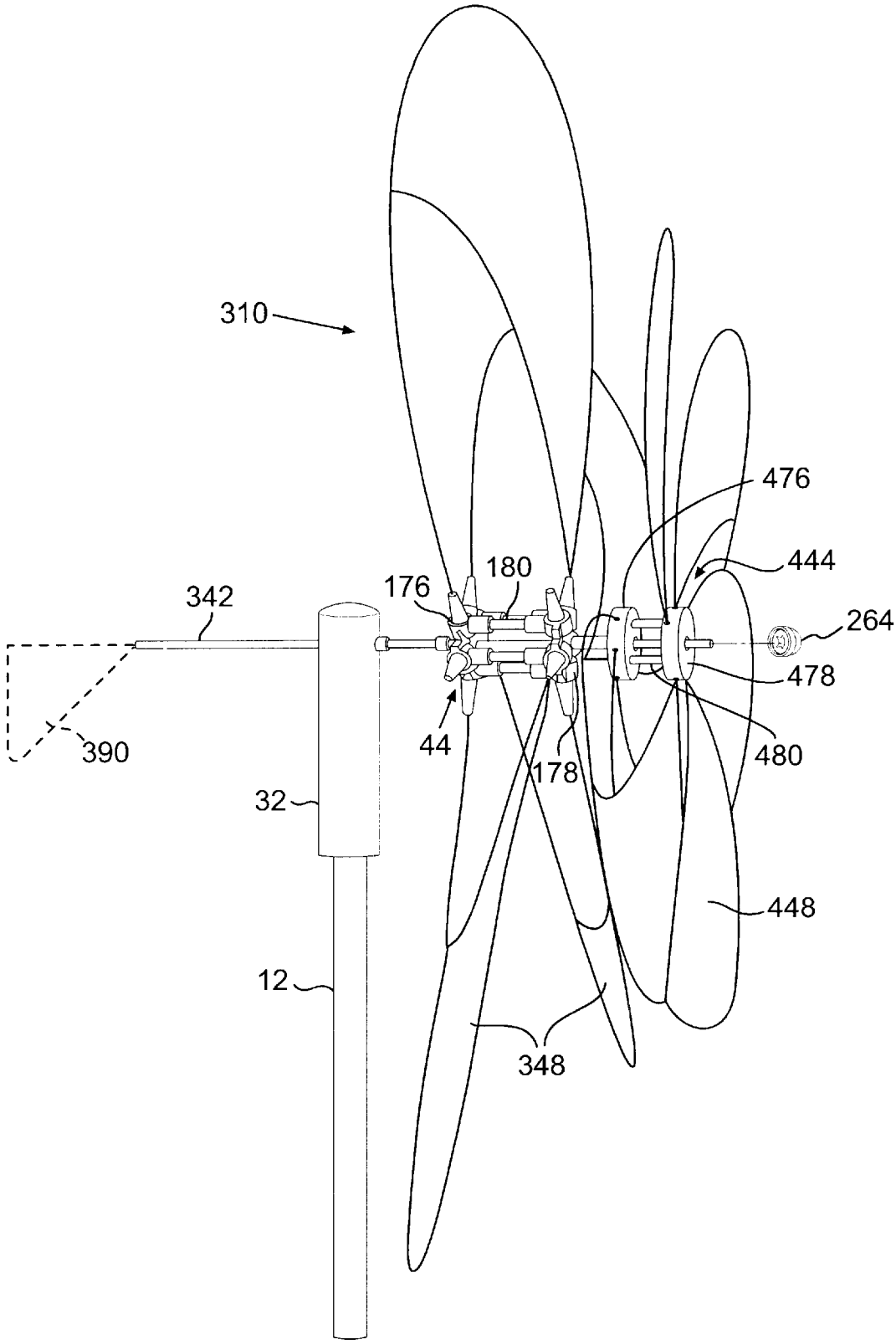
FIG. 17 is an illustration of another embodiment of the present invention.

FIG. 17 illustrates still another embodiment 310 of the present invention where the spindle 44 forms the rotational basis for the spinning vanes 348. In one embodiment of this example, the wind indicator 310 takes the form of a spinning flower with the web 328 extending only on the vanes 348. As would be appreciated by those skilled in the art, however, a tail 390 (shown in dotted lines) may be affixed to the spindle axis 342 to provide additional surface area of the web 328 to turn the wind indicator 310 in a passing breeze.

FIG. 17 also illustrates an alternative embodiment of the spindle, in this case spindle 444. The spindle 444 is made up of two cylindrical hubs 476, 478 connected to one another via two or more connecting elements 480. As in previous examples, the vanes 448 extend between the hubs 476, 478 to catch a passing breeze and, thereby, rotate the spindle 444. In all other respects the spindle 444 operates in the same manner as the spindle 44.

The embodiments of the present invention that are discussed above are intended to be exemplary of the scope of the present invention. Under no circumstances is the discussion of the particular embodiments intended to limit the scope of the invention, as embodied on the claims appended hereto. It is likely that there are those skilled in the art who will appreciate several variations of the embodiments described above. These alternatives are intended to be a part of the invention, just as if they had been described herein.

What is claimed is:

1. A wind indicator, comprising:

a body comprising a frame including a spindle axis, and a web disposed on at least a portion of the frame;

a pivot connected to the frame, wherein the pivot permits the body to rotate about a pivot axis;

a spindle disposed on and rotatable about the spindle axis, the spindle comprising a first hub comprising a first hub central body portion and at least one first vane support receiving element extending outwardly therefrom, and a second hub comprising a second hub central body portion and at least one second vane support receiving element extending outwardly therefrom;

at least one element connecting the first hub to the second hub to maintain the first and second hubs in positional relation with respect to one another, the at least one element being offset from the spindle axis by a predetermined distance; and at least one vane extending between the first and second vane support receiving elements, the vane being capable of capturing air movement and translating it into rotational movement of the spindle.

2. The wind indicator of claim 1, wherein the web comprises one selected from a group comprising a woven material, a non-woven material, and a combination of woven and non-woven materials.

3. The wind indicator of claim 2, wherein the woven material is resistant to degradation and fading when exposed to environmental conditions for extended periods of time.

4. The wind indicator of claim 2, wherein the woven material is sewn onto the frame.

5. The wind indicator of claim 1, further comprising:

a stake, onto which the pivot is disposable, to support the wind indicator above one of either a ground surface or a support element.

6. The wind indicator of claim 1, wherein the pivot further comprises:

a pivot body with first and second ends;

a first hole defined in the first end of the pivot body for receiving a stake therein;

a second hole defined through the pivot body for receiving the spindle axis therethrough.

7. The wind indicator of claim 6, further comprising:

a first collar disposed within the first hole within the pivot body; and a second collar disposed on an upper end of the stake, wherein the first collar interferes with the second collar when the upper end of the stake is inserted into the first hole to discourage disengagement of the stake from the first hole.

8. The wind indicator of claim 6, wherein the pivot further comprises:

second and third holes defined by the pivot body for receiving ends of a support wire therein.

9. The wind indicator of claim 1, wherein the first and second hubs are mirror images of one another.

10. The wind indicator of claim 9, wherein the first and second hubs further comprise:

at least two supports extending outwardly from the hub central body portion; and at least two vane support receiving elements attached to the supports.

11. The wind indicator of claim 10, wherein the first and second hubs further comprise:

at least three supports extending outwardly from the hub central body portion; and at least three vane support receiving elements attached to the supports.

12. The wind indicator of claim 11, wherein the first and second hubs further comprise:

five supports extending outwardly from the hub central body portion;

a vane support structure connected to the five supports; and five vane support receiving elements defined within the vane-support structure.

13. The wind indicator of claim 1, wherein the first and second hubs further comprise:

at least one connector element receiving portion extending longitudinally from one side of each of the hubs, wherein the connector element extends between the connector element receiving portions on the hubs.

14. The wind indicator of claim 13, wherein the at least one connector element receiving portion has a cross-sectional shape selected from a group comprising triangular, square, rectangular, polygonal, elliptical, and ovoid.

15. The wind indicator of claim 14, wherein the at least one connector element has a cross-sectional shape selected from a group comprising triangular, square, rectangular, polygonal, elliptical, and ovoid.

16. The wind indicator of claim 1, wherein the at least one connector element has a cross-sectional shape selected from a group comprising triangular, square, rectangular, polygonal, elliptical, and ovoid.

17. The wind indicator of claim 1, further comprising:

at least one sound-generating device coupled thereto.

18. The wind indicator of claim 17, wherein the at least one sound generating device is coupled to the spindle.

19. The wind indicator of claim 17, wherein the at least one sound-generating device is rotationally attached to the spindle axis and operationally fixed to the spindle for rotation together therewith.

20. The wind indicator of claim 1, further comprising:

an acorn hub with gripping elements therein, wherein the acorn hub is removably attached to one end of the spindle axis to releasably retain the spindle thereon.

* * * * *